United States Patent [19]

Tarpley, Jr.

[11] 4,156,594

[45] May 29, 1979

[54] THIXOTROPIC GEL FUELS

[75] Inventor: William B. Tarpley, Jr., West Chester, Pa.

[73] Assignee: Energy and Minerals Research Co., Kennett Square, Pa.

[21] Appl. No.: 857,325

[22] Filed: Dec. 5, 1977

[51] Int. Cl.[2] ..... C01L 7/00; C01L 7/02

[52] U.S. Cl. ..... 44/7 B; 44/7 A; 44/7 C; 44/7 D; 44/7 E; 44/51; 252/316

[58] Field of Search ..... 44/7 R, 7 A, 7 B, 7 C, 44/51, 7 D, 7 E; 149/21, 108.2, 118; 252/316

[56] References Cited

U.S. PATENT DOCUMENTS

| | | | |
|---|---|---|---|
| 2,754,267 | 7/1956 | Bondi | 252/29 |
| 3,095,334 | 6/1963 | Scurlock | 44/7 D |
| 3,313,730 | 4/1967 | Caruso | 44/7 D |
| 3,539,406 | 11/1970 | Lissant | 60/219 |
| 3,907,134 | 9/1975 | Metzger | 44/51 |
| 4,045,092 | 8/1977 | Keller | 44/51 |

*Primary Examiner*—Leland A. Sebastian

*Attorney, Agent, or Firm*—Seidel, Gonda, Goldhammer & Panitch

[57] ABSTRACT

A thixotropic gel fuel composition capable of being used in standard type oil burners comprising about 5 to about 75 volume percent of a solid carboniferous combustible material suspended in a liquid fuel and about 1 to about 10 weight percent of a substantially completely combustible gelling agent, the composition having a yield stress of about 20 to about 300 dynes per square centimeter. The composition may also contain ash modifiers.

19 Claims, No Drawings

THIXOTROPIC GEL FUELS

BACKGROUND OF THE INVENTION

The present invention relates to stable thixotropic gel fuel compositions wherein a solid combustible material is suspended in a liquid fuel along with a gelling agent and, optionally, an ash modifier. The compositions are intended to be burned as fuels in standard type residential, commercial and industrial oil burners.

Recent events have underscored the need to conserve our natural resources, and more particularly, our dwindling supply of oil. One suggested manner of dealing with the energy problem has been to use more coal and solid fuels until more oil or alternate forms of energy can be discovered and commercially developed. The use of solid fuels could also reduce our dependence on foreign oil. However, most residential, commercial and industrial fuel users do not have equipment which can presently use solid fuels. Accordingly, the equipment, generally consisting of gas or oil furnaces, must either be replaced or converted to be able to burn the solid fuel.

The present invention comprises a stable thixotropic gel fuel composition which can be burned in standard types of oil furnaces, such as that described in J. J. Demeter et al., "Combustion of Coal-Oil Slurry in a 100 HP Firetube Boiler", U.S. Energy Research and Development Administration publication #PERC/RI-77/8, May 1977, with a minimal increase in cost. The Library of Congress Congressional Research Service has reported that the cost involved in converting a gas fired furnace or an oil fired furnace to one capable of burning presently known coal/oil mixtures would be about one-fourth of the cost of replacing a gas fired furnace or oil fired furnace with a solid fuel fired furnace. It is believed that the cost of conversion would be even less with the compositions of the present invention.

The present invention incorporates a solid carboniferous combustible material in a liquid fuel and a gelling agent to form a stable thixotropic gel fuel composition. The amount of heat energy derived from a given volume of compositions according to the present invention having a high solids content should be significantly more than the heat derived from the same volume of liquid fuel, apparently because the generally denser, solid combustible material is able to deliver more heat than the generally less dense liquid fuel. Thus, by substituting more plentiful solid combustible material for the less plentiful liquid fuel, more heat energy can be delivered while liquid fuel resources can be conserved.

The solid combustible material particles incorporated in the thixotropic gel fuel composition of the present invention will remain suspended indefinitely, overcoming the stability and settling problem of prior art compositions. There is no settling or agglomeration of the solid combustible material particles. Nor is there any need to resort to the prior art technique of ultra-fine grinding of the solid combustible material which was used to produce a suspension that was stable only for about one month. Thus, the solid combustible material intended for use in the present invention need only be ground in the customary manner of grinding the material when it is intended for combustion purposes.

The thixotropic gel compositions of the present invention do not require complex suspending agents, such as coal tar or surface-active materials, which interfere with the atomization process in the furnace or burner.

Rather, the present fuels are formulated of particular gelling agents to produce thixotropic gels which can immediately break apart upon injection in the furnace.

In addition, the thixotropic gel fuels made from the hereinafter described particulate gelling agents are far less sensitive to temperature thinning than prior art compositions. Thixotropic gelation provides gels having the advantage of solid-like immobility, similar to grease, during storage and transportation, but imparts to the compositions the ability to shear thin to apparent viscosities approximating those of the unmodified liquid fuel when pumped or atomized. Therefore, the thixotropic gel fuels of the present invention can be transported, delivered and used with the conventional equipment and methods used with liquid fuels, such as fuel oil.

Numerous attempts have been made in the past to provide a stable suspension or slurry of a solid combustible material in a liquid combustible material, but without much success. Problems of stability, transportation, storage, handling and use have yet to be overcome. The present invention overcomes these problems and is distinguishable from and patentable over prior art compositions, including those disclosed in the following patents, which are believed to be the most relevant prior art known to applicant.

U.S. Pat. No. 2,938,779 of Kolfenbach et al. discloses a jet fuel having three components: a liquid hydrocarbon fuel; particles of a combustible solid selected from the class consisting of aluminum, magnesium and carbon; and a carbon black of high structure index. It is disclosed that the jet fuel compositions generally possess a semi-fluid or gel-like structure in which the particles of combustible solid are uniformly suspended throughout the liquid hydrocarbon component by the structure black. It is stated that the fuels are characterized by a marked structural stability and uniformity over a wide range of temperatures and they possess flow characteristics that permit them to be transported by means of pumps, lines, etc. There is no mention in the patent, however, that the gels are thixotropic.

Moreover, there is no indication or suggestion in the patent that the jet fuel compositions may be used with standard type oil burners. Thus, a composition which is a suitable jet fuel may not be suitable for use in heating, and for other commercial and industrial purposes. In addition, the carbon blacks disclosed in the patent may not be equivalent to the carbon blacks used in the compositions of the present invention. Thus, the difference in structure between carbon blacks may result in different properties for the compositions containing the carbon blacks.

U.S. Pat. No. 3,414,443 of Pheasant et al. discloses incendiary compositions useful in distress signals and for distress fires. The compositions comprise from 30 to 75 volume percent of finely divided solid fuels having a heat of combustion greater than 9.0 Kcal./ml. uniformly disposed in a gelled meltable solid fuel. The solid fuels comprise finely divided metal powders, such as boron, aluminum, zirconium, magnesium, lithium and metal hydrides. The meltable solid fuels include paraffin wax or lithium metal which are gelled while in the liquid state. Some of the gelling agents disclosed in this patent may be used to gel the compositions according to the present invention.

It is clear that the incendiary compositions disclosed in this patent are not suitable for burning in oil burners. Problems relating to transportation, storage, delivery and use would result from the presence of the meltable solid fuels in the compositions.

U.S. Pat. No. 3,620,698 of Schlinger et al. discloses a partial oxidation process for the production of synthesis gas from a thixotropic slurry. The slurry comprises about 10 to 75 weight percent of particulate solid carboniferous fuels in water or in a hydrocarbon liquid fuel containing about 2 to 10 weight percent of soot produced, for example, by partial oxidation of crude oil. The partial oxidation of the slurries are accomplished using an annulus type burner wherein an oxidizing gas or a mixture of oxidizing gas and steam hits a relatively low velocity stream of the slurry, atomizing it and gasifying the atomized particles to form synthesis gas.

The main purpose of the present invention is to produce heat developed when the compositions according to the present invention are substantially completely oxidized during burning in a standard type oil burner. The combustion products formed in the present invention include carbon dioxide and water vapor, rather than carbon monoxide and hydrogen. In addition, there is no indication or suggestion that the soot particles suitable for use as a slurry gelling agent in the patented process are equivalent to the carbon blacks used in the present invention. The patented soot appears to have a high ash content of 3.36 to 4.64 weight percent. This is significantly higher than the 2% ash content than is present in the carbon blacks used as the gelling agent in the present compositions. It appears that the compositions disclosed in the patent are gasified, whereas the compositions according to the present invention are burned.

U.S. Pat. No. 1,390,232 of Bates discloses a process for forming a liquid coal-oil slurry wherein the coal is pulverized in the oil to promote fuel stability. Stability is further enhanced by addition of peptizing agents, such as coal derivatives or distillates or by the addition of protective colloids or soaps, such as lime-rosin soap. The coal particles tend to separate from the patented mixture (p. 2. lines 103–107). This patent defines "stable" as meaning "non-separation of the components to a reasonable extent and for a reasonable time sufficient to enable the use of the fuel by atomizing it as fuel oil is now used" (p. 2, lines 121–126). Thus, it is clear that the "stability" of the patented composition is not comparable to the stability of the present compositions wherein the solid particles are not suspended only to a reasonable extent and only for a reasonable time, but rather, are suspendable for many months, and even years. The stabilizing agents of this patent do not appear to form a thixotropic gel of the coal-oil slurry.

U.S. Pat. No. 1,647,471 of Plauson discloses a non-settling liquid suspension or emulsion of a solid combustible carbonaceous material in a liquid fuel. Optional emulsifying agents which accelerate emulsification include soap solutions, rubber solutions, or other colloidal material. In order to form the disclosed emulsion, it is essential to use a cross hammer mill to work the mixture for 1 to 2 hours. There is no recognition or suggestion that the emulsification or suspension is thixotropic.

U.S. Pat. No. 3,095,334 of Scurlock discloses a thixotropic gel fuel comprising a finely divided insoluble solid oxidizer in a non-volatile, substantially shock insensitive liquid fuel containing thixotropic gelling agents compatible with the non-volatile liquid fuel. Finely divided, solid metal powders may be added to the composition to increase density and improve specific impulse, which is particularly important when the fuel is a monopropellant. The solid combustible materials used in the composition of the present invention are not metal powders or oxidizers, but rather are carboniferous materials. The present composition is intended for use in standard oil burners which are adapted to use fuel without oxidizers within the fuel composition itself.

U.S. Pat. No. 3,449,178 of Tarpley, Jr. discloses thixotropic liquid oxidizer propellant mixtures comprising a mixture of a particular carbon black added to liquid oxidizer propellants. The gel has a yield stress of about 40 to 1500 dynes per square centimeter and may contain surfactants or solid materials which are non-reactive at storage temperatures. The mixtures are formed by shear working or ultrasonic dispersion. The patented compositions are not well suited for burning in standard type oil burners.

Other relevant patents which relate to coal in oil slurries, but which are not considered to be as relevant as the patents discussed above due to the different types of characteristics and stabilizing components, include: U.S. Pat. No. 2,397,859 of Hersberger et al., U.S. Pat. No. 2,668,757 of Hansley et al., U.S. Pat. No. 2,754,267 of Biondi, U.S. Pat. No. 3,210,168 of Morway, U.S. Pat. Nos. 3,539,406, 3,613,372 and 3,617,095, all of Lissant, U.S. Pat. No. 3,732,084 of Nixon et al. and U.S. Pat. No. 4,030,894 of Marlin et al.

None of the patents described or listed above teach or suggest the use of ash modifiers in accordance with another embodiment of the present invention.

SUMMARY OF THE INVENTION

The present invention comprises thixotropic gel fuel compositions comprising about 5 to about 75 volume percent of a solid carboniferous combustible material suspended in a liquid fuel, and about 1 to about 10 weight percent of a substantially completely combustible gelling agent selected from the group consisting of natural and synthetic gums, resins, modified castor oil polymers, butyl rubber, para-tertiary-butyl styrene polymers, amine reacted carboxypolymethylene resins, and methyl vinyl ether-maleic anhydride copolymers and polyvinyl sulfonate, the latter two gelling agents being useful for gelling the more polar liquid fuels, the composition having a yield stress of about 20 to about 300 dynes per square centimeter.

The thixotropic gel fuel compositions are intended for use in standard type oil burners. Accordingly, the present invention includes a method of producing heat by burning the compositions according to the present invention in a standard type oil burner.

In addition, another embodiment of the present invention includes the incorporation of ash modifiers in the thixotropic gel fuel compositions so as to minimize the amount of ash fouling in the burning apparatus. Some of the ash modifiers raise the melting point of the ash so that it is exhausted with the flue gases. Another type of ash modifier reduces the melting point of the ash so that the compositions can be used in wet bottom furnaces wherein the ash forms a type of slag which flows to the bottom of the furnace.

DESCRIPTION OF THE PREFERRED EMBODIMENTS

The main components of the compositions according to the present invention are a solid carboniferous combustible material, a liquid fuel and a substantially completely combustible gelling agent in one embodiment of the invention. Another embodiment of the invention includes the same components with the addition of an effective amount of an ash modifier to modify the melting point of any ash produced by the burning of the composition to prevent the ash from fouling the furnace or other burning apparatus.

The solid carboniferous combustible material which is incorporated in the thixotropic gel fuel may be any combustible material containing carbon which is insoluble in the liquid and capable of being suspended in the thixotropic gel. Suitable carboniferous materials include coal, coke, pitch, charcoal, tar sand, oil shale, wood fibers, waste paper, waste carbon paper, bagasse, waste agricultural products, char, etc.

It is preferred for combustion efficiency that the solid carboniferous combustible material be finely divided, but it is not necessary that the particles be of colloidal size. In fact, in suitable furnaces, granules can be used. A suitable particle size would be wherein about 80 weight percent pass through a 200 mesh screen and are retained on a 325 mesh screen, although smaller particles could be used. The solid combustible material should comprise about 5 to about 75 volume percent of the composition.

The liquid fuel in which the solid carboniferous combustible material, is suspended need only be combustible and gelable. Preferably, the liquid fuel has a lower ignition point than the solid material to pilot the ignition of the solid material as the composition is atomized in the furnace.

Suitable liquid fuels include fuel oils; alcohols; waste organic solvents, such as benzene, acetone, chlorinated solvents which are generally decomposed by the heat generated by burning the gels, and other combustible, gelable wastes from industrial and chemical operations; gasoline; kerosene; naphtha; and the like. Various mixtures of liquid fuels may also be used.

The gelling agents to be used in this invention should be substantially completely combustible so as to avoid forming significantly more ash when the thixotropic gel compositions burn. As used herein, "substantially completely combustible" means that only about 2 weight percent ash remains after combustion of the gelling agent. The gelling agent should be present in an amount of about 1 to about 10 weight percent.

Two types of substantially completely combustible carbon blacks are useful as gelling agents in the compositions of the present invention. One type is formed from acetylene gas by continuous thermal decomposition and comprises colloidal size particles of carbon joined together in a chain-like fashion. Electron micrographs demonstrate that the particles are joined in a chain-like structure or fibrous fashion so that the mass of the carbon black is a persistent three-dimensional structure. This type of carbon black will be referred to herein as "acetylene black", and is available from Shawinigan Chemical Company, a division of Gulf Oil of Canada, Ltd.

Another type of carbon black which can be used in the practice of this invention has a clean micro-surface and a high degree of surface area, the surface being internal with particles smaller than 25 millimicrons as measured by an electron microscope and presenting a ratio of BET surface as determined by nitrogen adsorption measurement to electron microscope surface of between $2\frac{1}{2}$ and 6 and with larger particles being external, namely, possessing persistent reticulate chain formation observable in the electron microscope after mulling by the procedure of Ladd, *Rubber Age,* Volume 67, June 1945, pg. 299. This type of carbon black is available from Columbian Chemicals Division, Cities Service Co., Cabot Corporation, and Degussa, for example.

Other suitable substantially completely combustible gelling agents include hydroxypropyl cellulose, polyvinyl sulfonate, methyl cellulose, carrageenan and other natural and synthetic gums and resins, chemically modified castor oil of the type available from N.L. Industries, Inc. under the trademark "Thixcin R", butyl rubber, para-tertiary-butyl styrene polymers, amine reacted carboxypolymethylene resins, methyl vinyl ether-maleic anhydride copolymers, and the like.

With respect to the natural and synthetic cellulosic gums, hydration of these gelling agents with a small amount of water followed by cross-linking to form weak bonds permits the formation of gels in non-aqueous systems.

The function of the gelling agent is to keep the solid particles in the composition from contacting each other so that they do not adhere to each other, as by sintering or by Van der Waals attraction.

The thixotropic gel fuel compositions according to the present invention demonstrate reversible pseudoplasticity. That is, under conditions of relatively short relaxation time, the yield stress value possessed by these compositions permit them to retain their gel or gel-like form when under little or no external force. However, when subjected to the type of external force encountered in pumping the compositions for delivery to a storage tank or forces caused by the flow through the small orifices typical of injection nozzles in standard type oil burners and other combustion equipment, the compositions will be in liquid form. The compositions of the present invention resume their gel or gel-like structure almost immediately after being subjected to flow forces.

Yield stress represents the force necessary to cause the gel to liquefy and start to flow. The yield stress at which the thixotropic gel fuels become fluid can be readily adjusted by varying the amount of the components of the compositions. It is necessary that this yield stress be sufficiently high that the gravitational force on a suspended particle will not cause that particle to liquefy the gel beneath it so that the particle will settle. On the other hand, to move the thixotropic gel fuel compositions conveniently, to pump them with standard equipment and to drain storage and transportation tanks as completely as possible, it is desirable that the yield stress be kept as low as possible. The yield stress should be adjusted so that the self-supporting height of the gel will be very low, on the order of a few inches at most, whereby the tanks can be drained substantially completely of their contents without requiring special mechanical cleaners or drainers. Suitable yield stress values are about 20 to about 300 dynes per square centimeter.

Another embodiment of the present invention includes an effective amount of an ash modifier in the thixotropic gel fuel compositions discussed above. The ash modifier is stably suspended throughout the thixotropic gel. The ash modifier modifies the melting point of the ash produced by the burning of the composition to minimize or prevent the ash from fouling the furnace or other burning apparatus.

The ash modifiers should be added in an amount equivalent in weight to the ash content of the solid carboniferous combustible material and the liquid fuel present in the composition. For example, if the net ash content of coal and fuel oil in a composition according to the present invention amount to, say, 5–10%, then 5–10% of the ash modifying additives should be incorporated in the composition. Preferably, the ash modifiers have a particle size of less than 100 mesh.

One type of ash modifier acts to increase the melting point of the fused ash in the combustion zone to prevent its persistent deposition as a viscous liquid or solid on the walls of the furnace and on the heat exchange surfaces. The modified ash will be in the form of dry dust which is exhausted along with the flue gases generated in the furnace. Conventional scrubbers and like equipment may be used to remove the ash from the flue gases. Suitable additives which raise the melting point of the composition include silica, alumina, titania, zirconia, magnesium oxide, calcium oxide, or chemical compounds which will give these oxides on combustion, dolomite, kaolin and attapulgite clays.

The present compositions may be burned in wet-bottom furnaces wherein the ash is drained out as a liquid. When using the wet-bottom furnaces, it may be desirable to add ash modifiers which lower the viscosity and melting point of the ash so that it will drip down into the bottom portion of the furnace from which it will be removed, rather than forming persistent deposits on the walls and heat exchange surfaces of the furnace. Clays having an appreciable sodium or potassium content are useful in lowering the melting point of the ash to prevent it from fouling the furnace. Examples of suitable compounds include bentonites from Wyoming and Algeria and hectorite which have been found to have a relatively high sodium or potassium content.

The compositions according to the present invention are made by vigorously agitating a mixture of the components of the composition. This can be accomplished in many cases by shear working using conventional equipment, however, ultrasonic dispersion may be employed advantageously, especially where it is desirable to shorten the preparation time and improve the wetting of the carrier liquid and the particulate solids.

The order of addition of the components is generally not critical so long as an intimate mixture is obtained. Sometimes it is easier to from the thixotropic gels by mixing the gelling agent with a small amount of the liquid fuel before adding the remainder of the liquid and the other components.

The compositions according to the present invention may also be prepared in accordance with the procedure disclosed in the U.S. patent application Ser. No. 857,326 of William Tarpley, Jr. entitled "Thixotropic Gel Fuel And Method Of Making The Same", filed simultaneously with the present application, the disclosure of which is hereby incorporated by reference into the present application.

The present invention will now be described with reference to the following specific, non-limiting examples.

Examples 1–7 illustrate the first described embodiment of the present invention wherein the thixotropic gel fuel compositions do not contain ash modifiers:

| Ingredient | Volume Percent |
|---|---|
| Example 1 | |
| Coal Powder | 35 |
| No. 6 Fuel Oil | 64 |
| Acetylene Black | 1 |
| Example 2 | |
| Coal Powder | 25 |
| Butane | 10 |
| No. 6 Fuel Oil | 64 |
| Columbian Black | 1 |
| Example 3 | |
| Charcoal | 25 |
| Gasoline | 74 |
| Acetylene Black | 1 |
| Example 4 | |
| Charcoal | 20 |
| Ethyl Alcohol | 75 |
| Cabot Black | 5 |
| Example 5 | |
| Charcoal | 25 |
| Diesel Fuel | 74 |
| Cabot Black | 1 |
| Example 6 | |
| Coal Powder | 30 |
| No. 2 Fuel Oil | 65 |
| Modified Castor Oil Polymer (Thixcin R) | 5 |
| Example 7 | |
| Coal Powder | 25 |
| No. 6 Fuel Oil | 64 |
| Hydroxypropyl Cellulose | 3 |
| Water (to swell the hydroxy-propyl cellulose) | 8 |

Examples 8–10 illustrate other embodiments of the present invention wherein the thixotropic gel fuel compositions contain an ash modifier:

| | |
|---|---|
| Example 8 | |
| Coal Powder (high sulfur and ash content) | 25 |
| No. 6 Fuel Oil | 71.6 |
| Dolomite Powder | 2.4 |
| Acetylene Black | 1 |
| Example 9 | |
| Coal Powder (high ash content) | 30 |
| No. 6 Fuel Oil | 62.5 |
| Magnesium Oxide (−200 mesh) | 2.5 |
| Modified Castor Oil Polymer (Thixcin R) | 5 |
| Example 10 | |
| Coal Powder | 30 |
| No. 6 Fuel Oil | 61.8 |
| Kaolin (−200 mesh) | 3.2 |
| Modified Castor Oil Polymer (Thixcin R) | 5 |

The present invention may be embodied in other specific forms without departing from the spirit or essential attributes thereof and, accordingly, reference should be made to the appended claims, rather than to the foregoing specification as indicating the scope of the invention.

I claim:

1. A thixotropic gel fuel composition capable of being used in standard type oil burners comprising about 5 to about 75 volume percent of a solid carboniferous combustible material suspended in a liquid fuel, and about 1 to about 10 weight percent of a substantially completely combustible gelling agent which stably suspends the solid material in the liquid fuel, the gelling agent being selected from the group consisting of natural and synthetic gums and resins, modified castor oil polymers, butyl rubber, para-tertiary-butyl styrene polymers, amine reacted carboxypolymethylene resins, methyl vinyl ether-maleic anhydride copolymers and polyvinyl sulfonate, the composition having a solid-like immobility below a yield stress of about 20 to about 300 dynes per square centimeter.

2. A composition according to claim 1 wherein the liquid fuel has a lower ignition point than the solid combustible material.

3. A composition according to claim 1 wherein the liquid fuel is selected from the group consisting of fuel oils, alcohols and waste organic solvents.

4. A composition according to claim 1 wherein the solid combustible material is coal having a particle size between about 325 mesh and about 80 weight percent minus 200 mesh.

5. A composition according to claim 1 wherein the gum is selected from the group consisting of hydroxypropyl cellulose, carageenan and methyl cellulose.

6. A method of producing heat by burning the composition of claim 1 in a standard type oil burner.

7. A method of producing heat by burning the composition of claim 2 in a standard type oil burner.

8. A method of producing heat by burning the composition of claim 3 in a standard type oil burner.

9. A method of producing heat by burning the composition of claim 4 in a standard type oil burner.

10. A method of producing heat by burning the composition of claim 5 in a standard type oil burner.

11. A thixotropic gel fuel composition having solid-like immobility at rest which is capable of being used in a standard type oil burner comprising about 5 to about 75 volume percent of a solid combustible material suspended in a liquid fuel, about 1 to about 10 weight percent of a substantially completely combustible gelling agent which stably suspends the solid material in the liquid fuel and an effective amount of an ash modifier to modify the melting point of any ash produced by the burning of the composition to minimize ash fouling of the burning apparatus.

12. A composition according to claim 11 wherein the liquid fuel has a lower ignition point than the solid combustible material.

13. A composition according to claim 11 wherein the liquid fuel is selected from the group consisting of fuel oils, alcohols and waste organic solvents.

14. A composition according to claim 11 wherein the solid combustible material is coal having a particle size between about 325 mesh and about 80 weight percent minus 200 mesh.

15. A composition according to claim 11 wherein the gelling agent is selected from the group consisting of carbon black, natural and synthetic gums and resins, modified castor oil polymers, butyl rubber, para-tertiary-butyl sytrene polymers, amine reacted carboxypolymethylene resins, methyl vinyl ether-maleic anhydride copolymers and polyvinyl sulfonate.

16. A composition according to claim 11 wherein the ash modifier modifies the ash to have a higher melting point and is selected from the group consisting of silica, titania, zirconia, dolomite, kaolin, attapulgite, magnesium oxide, calcium oxide and magnesium and calcium compounds which upon heating yield magnesium oxide and calcium oxide.

17. A composition according to claim 11 wherein the ash modifier is a bentonite or hectorite clay containing sodium and/or potassium to modify the ash to have a lower melting point.

18. A composition according to claim 11 wherein the ash modifier is present in an amount approximately equivalent to the ash content of the solid combustible material.

19. A composition according to claim 11 wherein the composition has a yield stress of about 20 to about 300 dynes per square centimeter.

* * * * *